US009669415B2

(12) United States Patent
Le Guyader et al.

(10) Patent No.: US 9,669,415 B2
(45) Date of Patent: Jun. 6, 2017

(54) LABORATORY CENTRIFUGE PROVIDED WITH MEANS FOR THE LOCKING OF A LID IN ITS CLOSED POSITION

(71) Applicant: AFI CENTRIFUGE, Chateau Gontier (FR)

(72) Inventors: Philippe Le Guyader, Poligne (FR); Jean-Claude Letourneur, Pornichet (FR); Norbert Rolland, Cholet (FR)

(73) Assignee: AFI CENTRIFUGE, Chateau-Gontier (FR)

( * ) Notice: Subject to any disclaimer, the term of this patent is extended or adjusted under 35 U.S.C. 154(b) by 473 days.

(21) Appl. No.: 14/265,636

(22) Filed: Apr. 30, 2014

(65) Prior Publication Data

US 2014/0329659 A1 Nov. 6, 2014

(30) Foreign Application Priority Data

May 2, 2013 (FR) ..... 13 54027

(51) Int. Cl.
*B04B 7/06* (2006.01)
*B04B 9/08* (2006.01)
(Continued)

(52) U.S. Cl.
CPC ..... *B04B 9/08* (2013.01); *B04B 7/02* (2013.01); *B04B 7/06* (2013.01); *E05B 17/0025* (2013.01);
(Continued)

(58) Field of Classification Search
CPC ..... E05B 17/0025; E05B 47/0012; E05B 2047/0069; B04B 9/08; B04B 7/06; B04B 7/02; B04B 2009/085
(Continued)

(56) References Cited

U.S. PATENT DOCUMENTS 4,978,153 A * 12/1990 Hirsch ..... B04B 7/06 292/201
5,280,975 A * 1/1994 Tscheu ..... B04B 7/06 292/157
(Continued)

FOREIGN PATENT DOCUMENTS

EP 1 136 131 A2 9/2001
EP 2626138 A2 * 8/2013 ..... B04B 7/06
(Continued)

OTHER PUBLICATIONS

FR Search Report, dated Mar. 26, 2014, from corresponding FR application.

*Primary Examiner* — Charles Cooley
(74) *Attorney, Agent, or Firm* — Young & Thompson

(57) ABSTRACT

A laboratory centrifuge includes elements (10) for the locking of a lid in a closed position, which locking elements (10) include at least one strike (11) and at least one bolt (12) mobile between a locking position and an unlocking position. These locking elements (10) also include operating elements (15) including a motor shaft (16) that is coupled to the bolt (12) through transmission elements (17). The transmission elements (17) include a crank (18), extending the motor shaft (16), which carries an actuating member (19) bearing on a contact surface (**12*c*1, 12*c*2) formed on the bolt (12), so that the driving into eccentric rotation of the actuating member (19) about the motor axis of rotation (16') causes its circulation and bearing along the contact surface (12*c*1, 12*c*2) and the rotational control of the bolt (12**) between its locking and unlocking positions.

20 Claims, 5 Drawing Sheets

(51) Int. Cl.
*B04B 7/02* (2006.01)
*E05B 47/00* (2006.01)
*E05B 17/00* (2006.01)

(52) U.S. Cl.
CPC .... *E05B 47/0012* (2013.01); *B04B 2009/085* (2013.01); *E05B 2047/0069* (2013.01)

(58) Field of Classification Search
USPC ..... 210/85, 363, 144; 494/1, 7–12, 16–21, 494/31, 33, 84; 70/84, 157, 277, 278.7, 70/432, 256, 257, 280–283, 158–162; 292/201, 202, 203, 194, 44, 49, 196, 97, 292/116, 117, 213, 208, 39, 51, 112, 160, 292/142, 144
See application file for complete search history.

(56) References Cited

U.S. PATENT DOCUMENTS 7,029,040 B2 * 4/2006 Lippoldt ..... B04B 7/06 292/122
7,815,560 B2 * 10/2010 Hayasaka ..... B04B 7/02 49/386
7,874,972 B2 * 1/2011 Hayasaka ..... B04B 7/02 292/201
7,938,765 B2 * 5/2011 Hayasaka ..... B04B 7/06 292/201
8,403,380 B2 * 3/2013 Ballhause ..... B04B 7/06 292/201
8,783,737 B2 * 7/2014 Marschner ..... B04B 7/06 292/195
2001/0024039 A1 * 9/2001 Lippoldt ..... B04B 7/06 292/197
2005/0173932 A1 8/2005 Lomicka et al.
2008/0220958 A1 * 9/2008 Hayasaka ..... B04B 7/02 494/7
2008/0305938 A1 * 12/2008 Hayasaka ..... B04B 7/06 494/12
2009/0212580 A1 * 8/2009 Ballhause ..... B04B 7/06 292/341.16
2013/0237399 A1 9/2013 Letourneur et al.
2014/0329659 A1 * 11/2014 Le Guyader ..... B04B 7/02 494/82

FOREIGN PATENT DOCUMENTS

FR 2 951 964 A1 5/2011
FR 2951962 A1 * 5/2011 ..... B04B 7/02

* cited by examiner

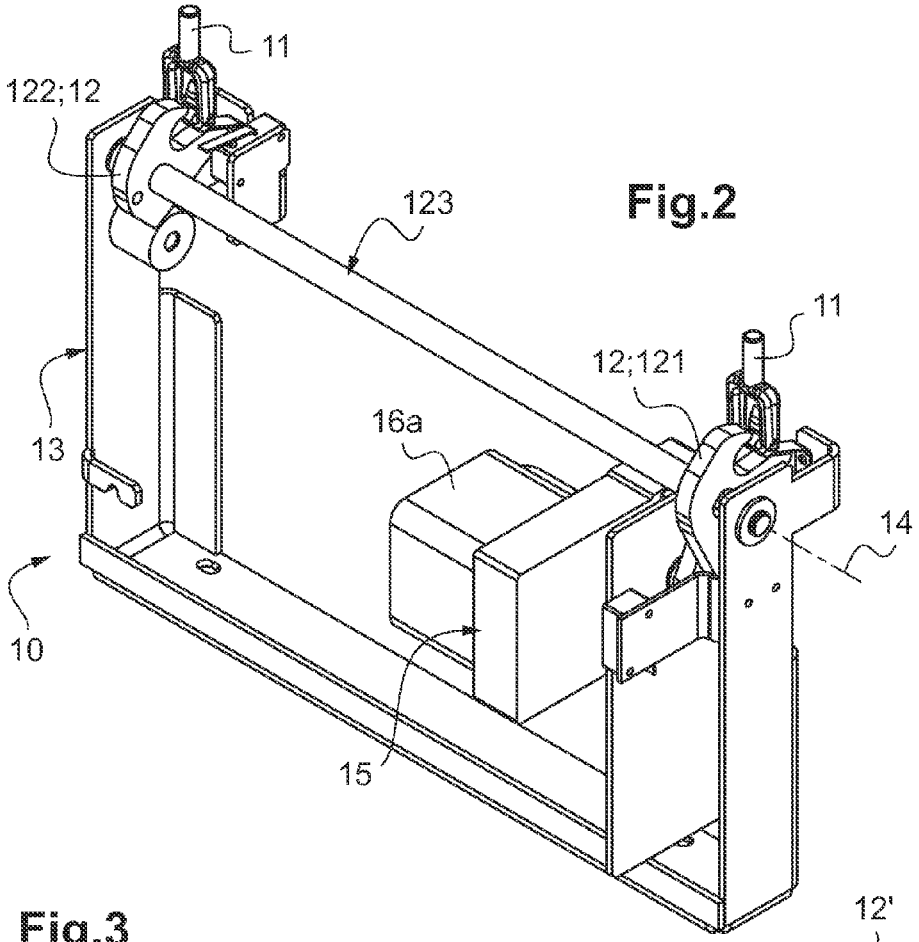
Fig.2
Fig.3
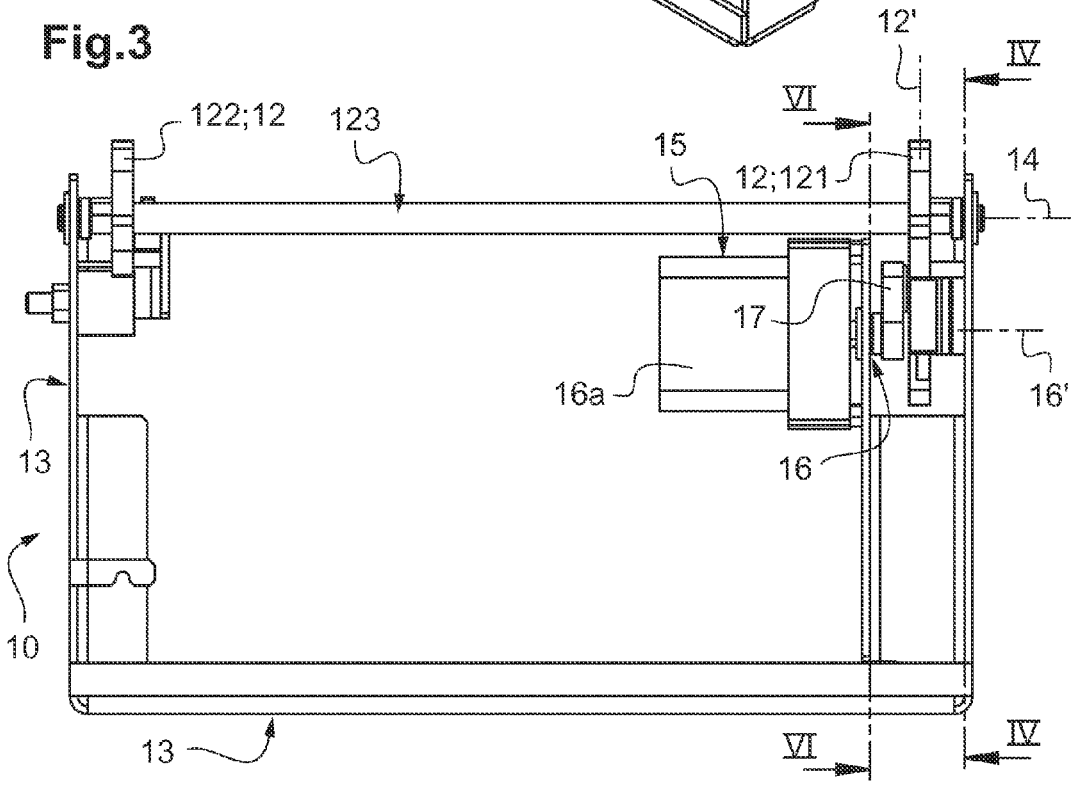

LABORATORY CENTRIFUGE PROVIDED WITH MEANS FOR THE LOCKING OF A LID IN ITS CLOSED POSITION

TECHNICAL FIELD TO WHICH THE INVENTION RELATES

The present invention relates to the general field of the laboratory centrifuges, for separating the components contained in a liquid through a phenomenon of centrifugation.

TECHNOLOGICAL BACKGROUND

Centrifugation allows to separate components of very variable size and mass contained in a liquid sample, from molecules to entire cells.

Indeed, the putting into rotation of a rotor carrying a container containing this liquid sample generates a centrifugal force that produces an acceleration that is exerted radially outwardly of the axis of rotation.

Hence, for a given component, by choosing correctly the speed of rotation, the acceleration obtained becomes predominant with respect to the molecular agitation, which causes its settling to the bottom of the container or its rising up to the surface.

For the implementation of this technique, a laboratory centrifuge is used, which comprises:

- a driving shaft, associated with motor means,
- a rotor removably mounted on said driving shaft, intended to receive the liquid samples to be centrifuged,
- a shielded bowl surrounding the rotor, delimiting an access opening,
- a casing that carries the shielded bowl, and
- a lid mobile between a closed position to close said access opening and an open position to clear said access opening, this lid being carried by and articulated on the above-mentioned casing.

Such a centrifuge is also provided with locking means to ensure the holding of the lid in its closed position during the whole cycle of centrifugation.

These locking means have to be moreover adapted to resist to the shocks produced by the rotor, or as the case may be by the cups thereof, in case of separation of the driving shaft at full speed, and to therefore hold the lid in the closed position.

Such locking means are for example described in the document FR-2 951 962.

These locking means comprise a bolt, equipping the casing, which is associated to operating means for its rotational displacement between:

- a locking position in which a hook of said bold is associated with a strike carried by the lid for holding the latter in the closed position, and
- an unlocking position, in which the bolt is dissociated from said strike to allow the pivotal operation of the lid between its open and closed positions.

The bolt operating means herein comprise:

- a motor shaft that is driven into rotation according to a motor axis of rotation extending parallel to the axis of rotation of the bolt, and
- a connecting rod connected, by a first one of its ends, to said bolt by means of a pivoting axis and, by a second one of its ends, to an eccentric mounted on said motor shaft.

Such a structure allows a relatively effective locking of the bolt in its locking position.

Within this framework, the bolt hook and the bolt/connecting rod pivoting axis are positioned on either side of the bolt pivoting axis, so that a lever arm liable to be exerted on the bolt is opposed to a lever arm liable to be exerted on said bolt/connecting rod pivoting axis.

Furthermore, in the locking position, it is needed that the bolt/connecting rod pivoting axis, the top point of the eccentric and the motor axis of rotation are aligned.

Now, in practice, this need for a precise alignment of three different points of the operating means makes such a structure relatively complex; further, the alignment of the three points is relatively difficult to respect due to the inertia of the gear motors, with a risk about the holding in position of the locking.

Moreover, this structure of the locking means is cumbersome due to the presence of the connecting rod interposed between the bolt and the eccentric. This mechanism is also complex as regards the number of parts, with the resulting problems of reliability and of holding of the locking.

The operation of the bolts, through such a structure of the locking means, further proves to be relatively slow.

OBJECT OF THE INVENTION

The present invention has for object to propose a centrifuge whose bolt operating means have a simplified structure and an improved reliability with respect to that of the prior art, while preserving an optimal force for the locking of the lid.

This laboratory centrifuge is of the type including—a casing surrounding a rotor that is accessible through an opening, —a lid mobile between a closed position to close said access opening and an open position to clear said access opening, and—means for locking said lid in said closed position.

These locking means comprise: —at least one strike (preferably equipping said mobile lid), —at least one bolt (preferably equipping said casing), which is mounted mobile in rotation about an axis of rotation between a locking position in which said bolt is associated with said strike, and an unlocking position in which said bolt is dissociated from said strike, and—means for operating said bolt, comprising a motor shaft that is driven into rotation about itself by motor means, according to motor axis of rotation extending parallel to the axis of rotation of said bolt, and that is coupled to said bolt through transmission means for the rotational operation of said bolt between its locking and unlocking positions.

According to the invention, said transmission means comprise a crank, extending said motor shaft, which carries an offset actuating member bearing on a contact surface formed on said bolt, so that the driving into eccentric rotation of said actuating member about said motor axis of rotation causes its circulation and bearing along said contact surface and the rotational control of said bolt between its locking and unlocking positions.

Generally, the laboratory centrifuge includes, on the one hand, a first longitudinal axis passing through the actuating member and through the motor axis of rotation, and on the other hand, a second longitudinal axis passing through said actuating member and through the axis of rotation of the bolt.

According to a preferred embodiment, the locking means are then arranged so that, in the locking position of the bolt, said first longitudinal axis extends square, or at least approximately square, relative to the second longitudinal axis.

This structural characteristic allows an optimal and rapid locking of the bolt in its closed position.

Indeed, the direction of a possible force of opening exerted by the bolt on the actuating member then extends coaxially to the above-mentioned first longitudinal axis, passing through the actuating member and through the motor axis of rotation.

This direction of the opening force hence exerts a null lever arm on the actuating member about the motor axis of rotation, with a null moment on the motor axis, hence avoiding any phenomenon of rotation of the associated motor shaft.

This locking position is "wide" in that it makes a certain clearance possible, allowing a better taking into account of the inertia of the gear motors and a simpler adjustment.

In this case, the contact surface of the bolt advantageously includes a locking segment that, in the locking position of the bolt:

- is located on the first longitudinal axis passing through the actuating member and through the motor axis of rotation, and
- extends square, or at least approximately square, with respect to said first longitudinal axis.

The actuating member advantageously consists in a cylindrical tenon that extends along a longitudinal axis oriented parallel to the motor axis of rotation. The contact surface of the bolt is then formed by an elongated hole that is formed in said bolt; this elongated hole is delimited by two longitudinal edges extending parallel to each other and arranged on either side of a radial longitudinal axis arranged perpendicular to the axis of rotation of said bolt.

In this case, the bolt advantageously includes:

- a hook adapted to cooperate with the strike, located on one side of its axis of rotation, and
- an extension in which is formed the hole, located on another side of its axis of rotation.

According to another interesting characteristic, the lid advantageously includes return means tending to cause the operation thereof towards its open position; and the centrifuge still includes means for holding the lid in a waiting position allowing an adapted positioning of the strike for the cooperation with the bolt operated to the locking position, which holding means are operable between two positions:

- an active position, to automatically secure the lid in said waiting position at the time of its operation from the open position to the closed position, and
- an inactive position, obtained by the operation of the bolt to the unlocking position, in which the holding means are inactivated to allow the action of said means for returning the lid to the open position.

In this case, the holding means advantageously comprise at least one elastically deformable member that is arranged to bear on the strike of the lid operated to the waiting position, and that is adapted to act against the action of the means for returning the lid towards the open position.

According to a first embodiment, the elastically deformable member is implanted opposite a hook of the bolt intended to cooperate with the strike.

The bolt then advantageously includes a bearing portion that is adapted, at the time of operation of the bolt to the unlocking position, to cause an operation of said elastic deformable member to the inactive position in which it is spaced apart from the strike of the lid.

According to a second embodiment, the elastically deformable member is carried by the bolt, above a hook adapted to cooperate with the strike.

DETAILED DESCRIPTION OF THE INVENTION

The invention will be further illustrated, without being limited in anyway, by the following description of a particular embodiment, in relation with the appended drawings in which:

FIG. 2 shows, in a perspective view, the locking means of the centrifuge according to FIG. 1;

FIG. 3 is a front view of the locking means according to FIG. 2;

Figure 5:
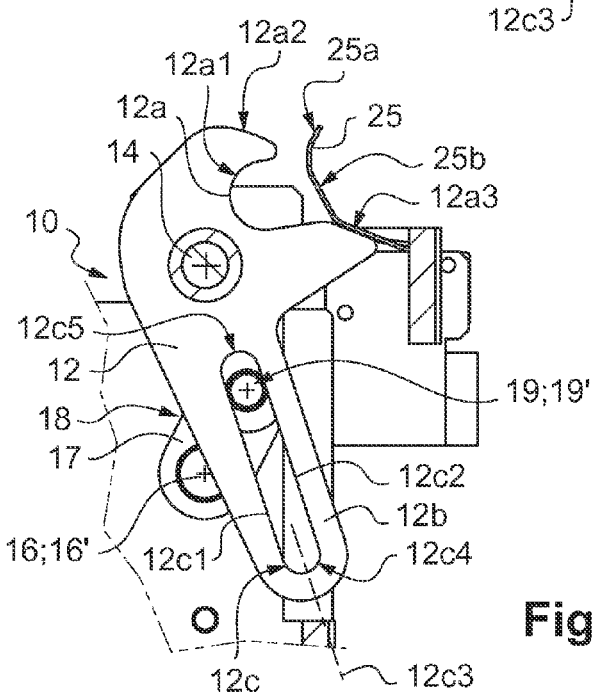
FIG. 5 is a partial and enlarged view of FIG. 4, showing its bolt and the associated operating means.
Figure 7:
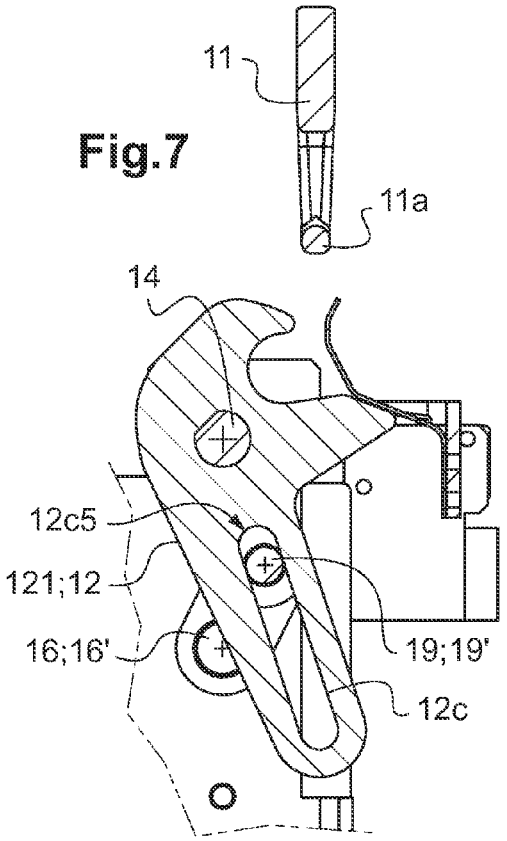
Figure 11:
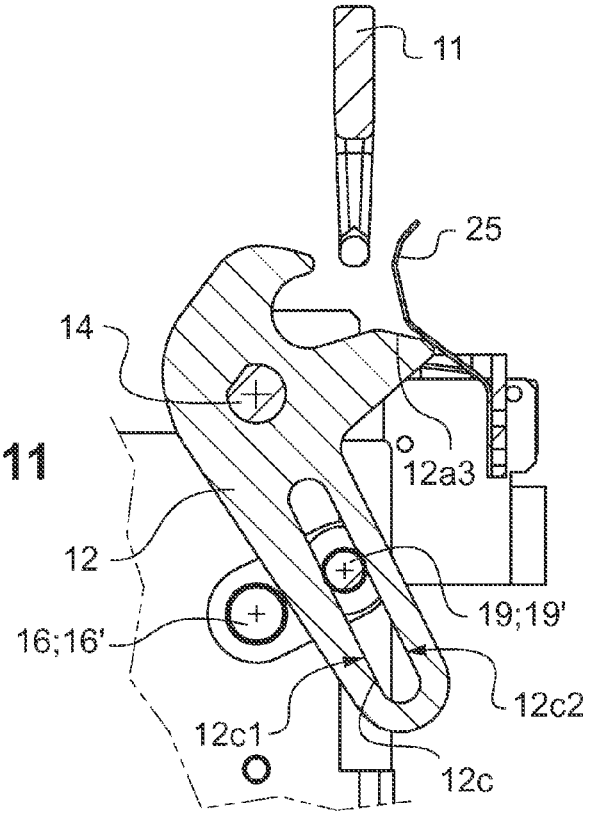

FIGS. 7 to 10 correspond to FIG. 5, illustrating the main steps of the kinematics at the time of operation of the bolt from its unlocking position to its locking position;

FIG. 11 illustrates the bolt in the unlocking position, in which a bearing portion of this bolt displaces, to an inactive position, the means for holding the lid in a waiting position.

Figure 1:
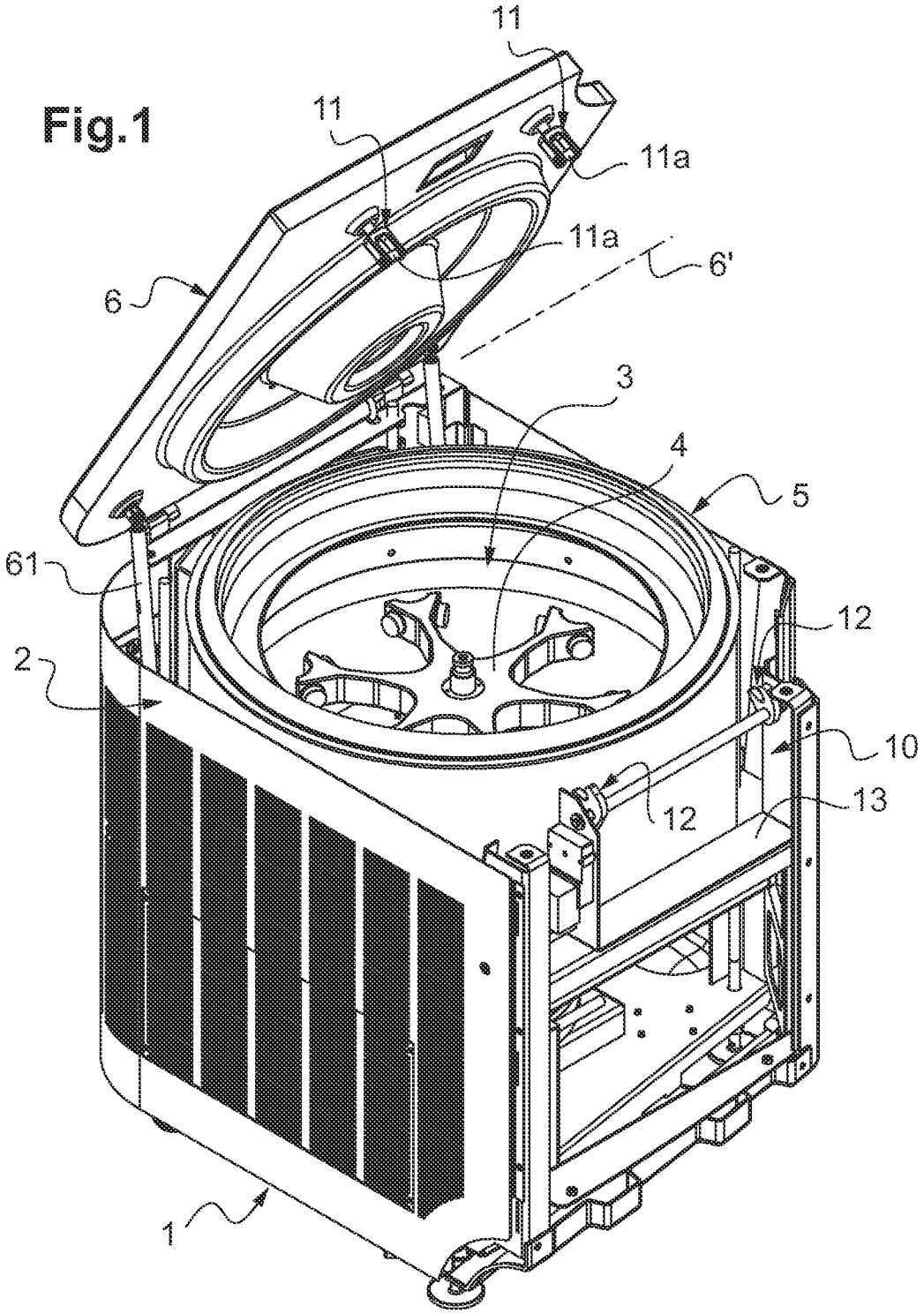
FIG. 1 is a general view of a laboratory centrifuge according to the invention, in which the lid is shown in the open position and in which a front wall of the casing is not shown so as to offer a visual access to the means that allow the locking of this lid in the closed position.
Figure 4:
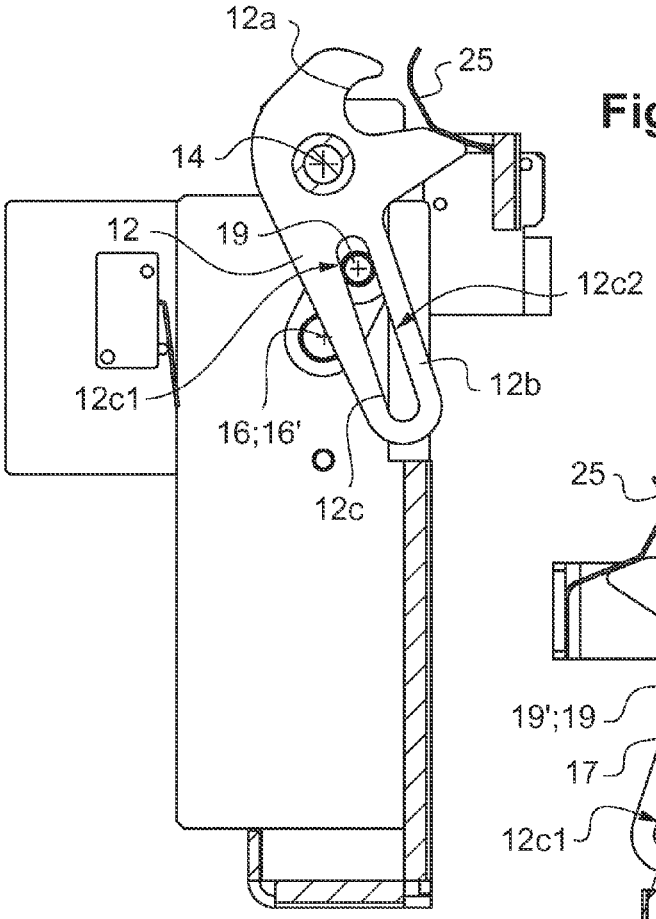
FIG. 4 is a cross-sectional view of FIG. 3, according to a cutting plane IV-IV passing through the axis of rotation of the bold and extending perpendicular to the latter.
Figure 6:
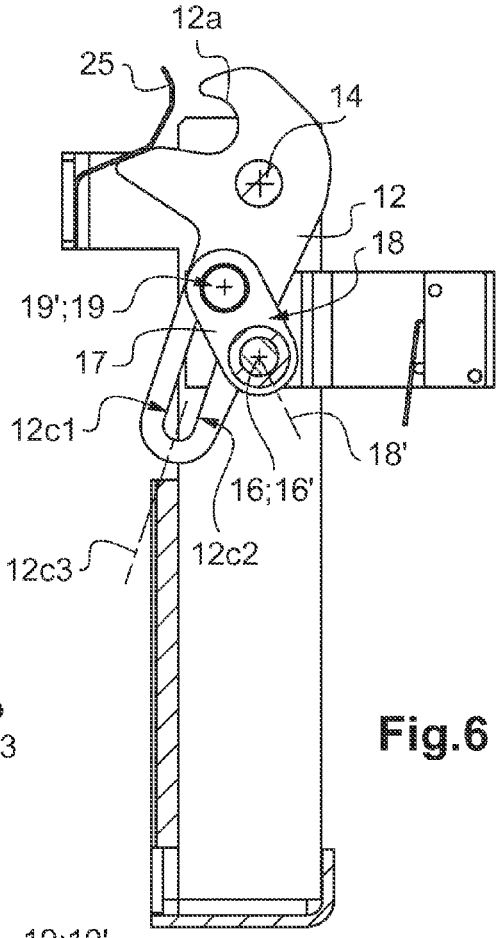
FIG. 6 is also a cross-sectional view of FIG. 3, according to a cutting plane VI-VI passing through the motor shaft and extending perpendicular to the latter.

The laboratory centrifuge 1 according to the invention, as shown in a general and perspective view in FIG. 1, comprises a casing 2 that integrates a shielded bowl 3 in which is located a rotor 4 removably mounted on a rotation driving shaft (not shown).

Conventionally, the rotor 4 is intended to carry containers (tubes, pockets, etc.) each receiving at least one liquid sample intended to undergo the centrifugation operations.

The rotor 4, illustrated in FIG. 1, is herein of the mobile buckets/cups rotor type (also called "swing out" or "sw rotor"). These mobile buckets, not shown in FIG. 1, are each mounted free in rotation about an axis extending horizontally and perpendicular to the axis of rotation of the rotor 4.

As an alternative, the rotor 4 could be of the fixed-angle type, in which the containers are placed in hollow accommodations generally inclined between 15° and 45° relative to the vertical.

The casing 2 and the bowl 3 delimit an access opening 5, opening upwards, for the access in particular to the rotor 4.

This casing 2 also carries a lid 6 mounted on hinges, for its pivoting according to a horizontal axis of rotation 6' between a closed position (not shown) to close the access opening 5 and an open position (FIG. 1) to clear this access opening 5.

This lid 6 includes return means 61 that tend to the operation thereof to its open position (FIG. 1).

The return means 61 herein consist for example in pneumatic cylinders, suitably arranged, exerting an upward pressure on this lid 6.

The lid 6, at rest, is herein in its open position; a downward pressure (by the operator) on the lid 6 allows to cause the operation thereof from its open position to its closed position.

The centrifuge 1 also includes means 10 for the locking of the lid 6 displaced to its closed position.

Conventionally, security means allow a putting into rotation of the rotor 4 only in the case where the lid 6 is in the closed and locked position. The closed and locked position of the lid 6 is, in practice, held as long as the rotor 4 is in rotation within the bowl 3.

These locking means 10 herein comprise, on the one hand, two strikes 11 equipping the mobile lid 6, and on the other hand, two bolts 12 equipping the casing 2.

The strikes 11 are arranged at each end (or substantially at each end) of a free edge of this lid 6, opposite to its edge rotationally mounted on the casing 2.

These strikes 11 each include a rod 11*a* (visible on FIGS. 1 and 7), extending parallel to the axis of rotation 6' of the lid 6, intended to cooperate with one of the bolts 12.

For their part, the two bolts 12 belong to a locking module 13, as illustrated in isolation in FIGS. 2 and 3, which is added (advantageously in a removable manner) within the casing 2.

These two bolts 12 are simultaneously mobile in rotation about a same axis of rotation 14, so as to each cooperate with one of the strikes 11 of the lid 6 in its closed position.

This axis of rotation 14 of the bolts 12 is herein parallel to the axis of rotation 6' of the lid 6.

The locking module 13 is equipped with operating means 15 for the rotational control of the bolts 12 between two end-of-travel positions, i.e.:

- a locking position or locked position (FIG. 10), in which the bolts 12 are each associated with a strike 11, and
- an unlocking position or unlocked position (in particular, FIG. 7), in which the bolts 12 are dissociated from the strikes 11.

The operating means 15 according to the invention have a mechanical structure that, despite its relative simplicity and its compactness, is adapted to ensure precise and rapid operation of the bolts 12 and to exert an optimal holding of these bolts 12 in the locked position.

In particular, the operating means 15 are adapted to prevent any accidental displacement of the bolts 12 from the locked position to the unlocked position.

This phenomenon occurs in particular in the case where a pressure force is exerted on the lid 6 in the direction of its opening, in particular at the time of an accidental detachment of the rotor 4 from its driving shaft, or an accidental detachment of a cup, leading to its projection and its collision against the lid 6 at full speed.

The corresponding operating means 15 are described hereinafter in details in relation with FIGS. 2 to 6.

These operating means 15 cooperate in particular with a first bolt 121, thus forming a "master" (or "motor") bolt (FIGS. 2 and 3).

The second "slave" bolt 122 is coupled in rotation with this first bolt 121 by means of a transmission shaft 123, which extends coaxially to their common axis of rotation 14 (FIGS. 2 and 3).

These operating means 15 comprise a motor shaft 16 (FIGS. 3 to 6) that is driven into rotation about itself by motor means 16*a* (FIGS. 2 and 3), for example an electric motorization conventional per se, piloted by control means (for example, electronic and/or software).

The motor shaft 16 pivots about a motor axis of rotation 16' (FIGS. 3 to 6), which extends parallel to the axis of rotation 14 of the bolts 12.

This motor shaft 16 is rotationally coupled to a bolt 12, in this case the master bolt 121, through transmission means 17 described hereinafter.

The corresponding bolt 121 consists in a plate having a median plane 12' that extends perpendicular to its axis of rotation 14 (FIG. 3).

This bolt 121 includes two portions, extending on either side of its axis of rotation 14, i.e.:

- a hook 12*a* adapted to hook on one of the strikes 11, located approximately on an upper side of the axis of rotation 14, and
- an extension 12*b* in which is formed an elongated hole 12*c* intended to cooperate with the above-mentioned transmission means 17, located approximately on a lower side of its axis of rotation 14.

The hook 12*a* includes several portions, i.e.:

- a notch 12*a*1, herein generally U-shaped, forming the hook itself intended to receive the strike 11, and
- two front bearing portions, an upper one 12*a*2 and a lower one 12*a*3, arranged on either side of the notch 12*a*1 and each intended to cooperate herein with lid holding means that will be described hereinafter.

The two front bearing portions 12*a*2 and 12*a*3 are each located in the continuation of one of the legs of the U-shaped notch 12*a*1.

Moreover, the contour of the elongated hole 12*c* forms a contact surface intended to cooperate with the transmission means 17.

This elongated hole 12*c* herein passes through the extension 12*b* of the bolt 121 and extends in the median plane 12' thereof.

As illustrated in FIG. 5, this elongated hole 12*c* has herein a generally straight oblong shape. It consists of two longitudinal edges 12*c*1, 12*c*2, which extend parallel to, and on either side of, a radial longitudinal axis 12*c*3 passing through the axis of rotation 14 of the bolt 121 and arranged perpendicular to this axis 14.

These are such two longitudinal edges 12*c*1, 12*c*2 that form, in practice, the contact surface intended to cooperate with the transmission means 17.

A first "rear" longitudinal edge 12*c*1 is located on a first side of the radial longitudinal axis 12*c*3, and is oriented in the same direction as the opening of the hook 12*a*; and a second "front" longitudinal edge 12*c*2 is located on a second side of the radial longitudinal axis 12*c*3, and is oriented at the opposite of the opening of the hook 12*a*.

The elongated hole 12*c* of the bolt 121 also includes two longitudinally opposite ends (FIG. 5), i.e.:

- a distal end 12*c*4, located remote from the axis of rotation 14, and
- a proximal end 12*c*5, located near this same axis of rotation 14.

For their part, the transmission means 17 comprise a crank 18, a first end of which is connected to the above-mentioned motor shaft 16, and a second end of which carries an actuating member 19, offset and extending along a longitudinal axis 19'.

The crank 18 herein consists in a generally oblong plate, extending in a plane that is perpendicular to the motor axis of rotation 16' and that is parallel to the plane 12' of the bolt 121.

The motor shaft 16 extends on the side of one of the two faces of this crank 18; and the actuating member 19 extends on the side of the other of the two faces of this crank 18.

This crank 18 has a radial longitudinal axis 18' (FIG. 6) that passes through the motor axis of rotation 16' and through the longitudinal axis 19' of the actuating member 19, and that extends perpendicular to these two axes 16', 19'.

The actuating member 19 herein consists in a cylindrical tenon, whose longitudinal axis 19' is oriented parallel to the motor axis of rotation 16'.

This actuation member 19 is hence driven into eccentric rotation about the motor axis of rotation 16', by the motor shaft 16 associated with the crank 18.

This actuating member 19 is accommodated through the elongated hole 12*c* of the bolt 121, perpendicularly to the median plane 12' of the latter.

The diameter of this actuating member 19 herein corresponds, to within the clearance, to the width of the elongated hole 12*c* of the bolt 121 (corresponding to the distance separating its opposite longitudinal edges 12*c*1, 12*c*2).

During its rotation about the motor axis of rotation 16', the actuating member 19 circulates and bears along the longitudinal edges 12*c*1, 12*c*2 of the elongated hole 12*c* of the bolt 121 (forming its contact surface) and, as a consequence, rotationally control this bolt 11 between its locking and unlocking positions as developed hereinafter in relation with FIGS. 7 to 11.

As further illustrated in FIGS. 4 to 10, the centrifuge 1 also includes means 25 for holding the lid 6 in a "semi-closed" waiting position.

This position allows a correct stable positioning of the rod 11*a* of the strike 11 opposite the hook 12*a* of the bolt 121, with a view to the operation of the bolt 121 to the locking position.

These holding means 25 herein consist of an elastically deformable member, which is implanted opposite the hook 12*a* of the bolt 121 and intended to cooperate with the strike 11 received by this bolt 121.

This elastically deformable member 25 is fastened to the casing 2, at one of its ends.

This elastically deformable member 25 herein consists in a semi-rigid tab or plate, made of a metal or plastic material.

As developed hereafter, it is in particular arranged so as to successively be retracted and bear, automatically, on the rod 11*a* of the strike 11 during the displacement of the lid 6 from its open position to its closed position.

This tab 25 includes for that purpose:

- an upper portion 25*a*, forming a ramp for the retraction of the tab 25 at the time of passage of the rod 11*a* of the strike 11, and
- a lower portion 25*b*, for its bearing on top of said rod 11*a* of the strike 11.

The rotational control of the bolts 12 between their locking and unlocking positions, by the actuating member 19, is described in more detail hereinafter in relation with FIGS. 7 to 11 for the master bolt 121.

In the unlocking position (FIG. 7), the bolt 12 has an inclination in which its hook 12*a* is tilted backwards so as to clear the descending travel trajectory of the complementary strike 11.

The actuating member 19 is herein located on the side of the proximal end 12*c*5 of the elongated hole 12*c* of the bolt 12.

At the time of operation of the lid 6 to its closed position by an operator, the strike 11 is displaced downwards, according to a circular trajectory centered on the axis of rotation 6' of the lid 6.

This strike 11 cooperates successively with the two above-mentioned portions 25*a*, 25*b* of the tab 25, i.e. firstly its upper portion 25*a*, for its retraction at the time of passage of the rod 11*a* of the strike 11, and its lower portion 25*b*, for its bearing on top of said rod 11*a* of the strike 11.

Figure 8:
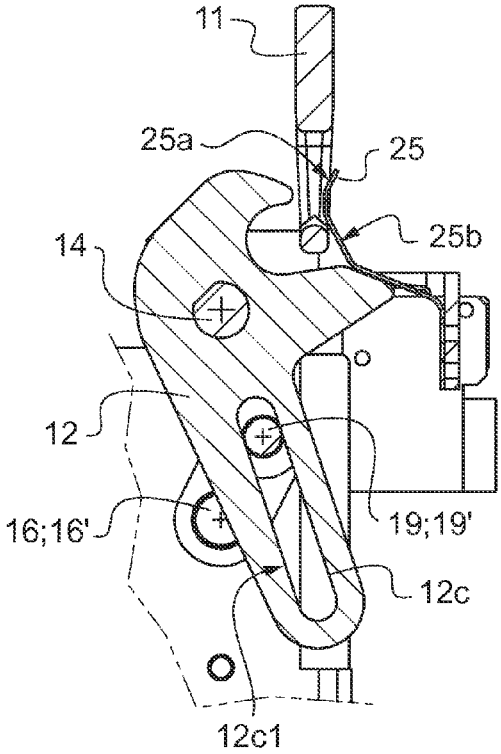

The elastically deformable member 25 bears on the strike 11 of the lid 6 that is then automatically held in a so-called "waiting" position with the rod 11*a* facing the hook 12*a* (FIG. 8).

This deformable member 25 then acts against the action of the means 61 for returning the lid 6 towards the open position; the lower portion 25*b* of the tab 25 then exerts a holding force that is higher than the pressing force exerted by the means 61 for returning the lid 6 to the open position.

The elastically deformable member 25 is then automatically in an active position, to secure the lid 6 in this "semi-closed" waiting position.

The control means are informed of the presence of strikes 11 by suitable detection means, conventional per se.

The operator can then control the centrifuge 1 for putting the rotor 4 into rotation.

Figure 9:
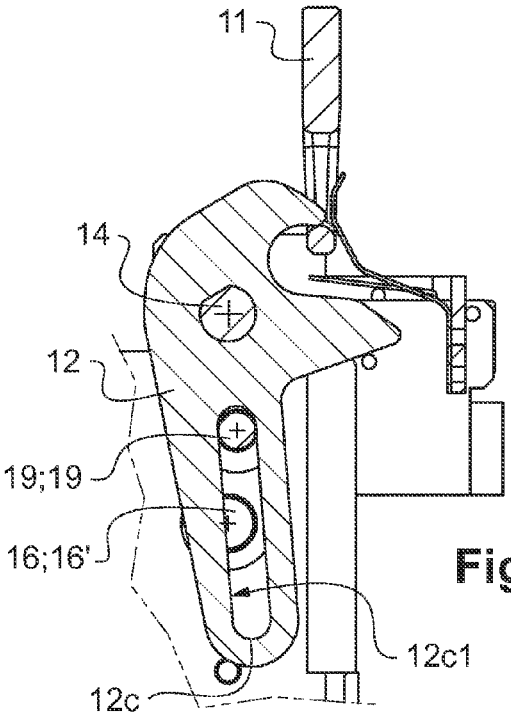
Figure 10:
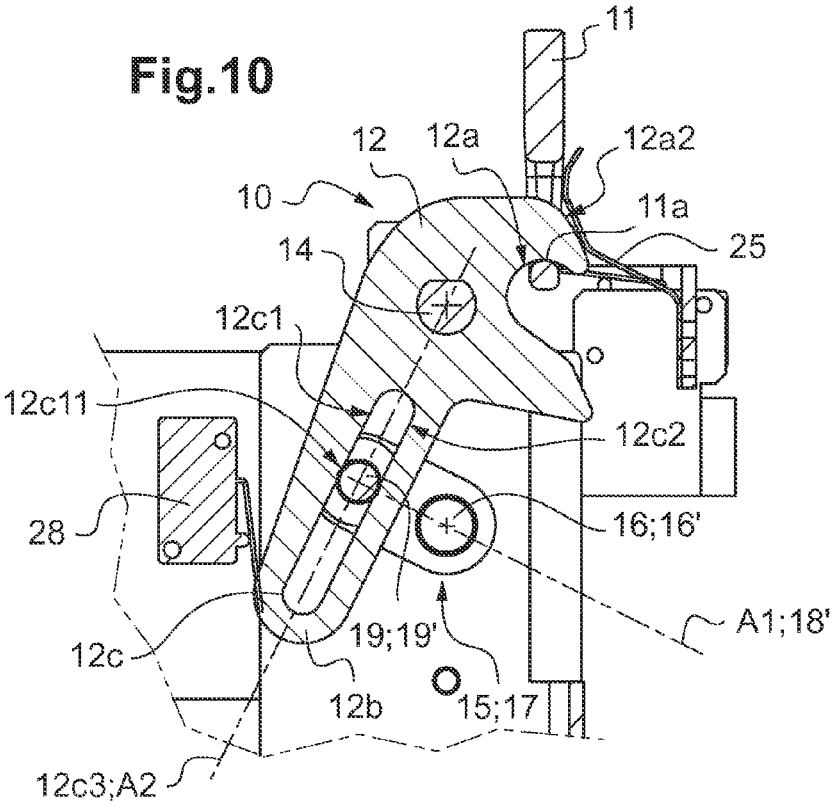

The strikes 11 having been detected, the centrifuge 1 then controls automatically the bolts 12 to a position of hooking with the complementary strikes 11, corresponding to an operation of the bolts 12 to their locking position (FIGS. 8 to 10).

For that purpose, the operating means 15 displace the bolts 12 in rotation about their axis of rotation 14, from the unlocking position to its locking position (FIGS. 8, 9 and 10).

To that end, the motor shaft 16 is pivoted to drive into rotation the actuating member 19 about the motor axis of rotation 16' (in a counterclockwise direction of rotation in FIGS. 8 to 10).

The actuating member 19 then travels according to a circular trajectory about the motor axis of rotation 16'. It also travels within the elongated hole 12*c*, while circulating and bearing along the contact surface formed by the rear longitudinal edge 12*c*1 (FIG. 10).

This action causes a rotation of the bolt 121 in a direction of rotation, herein a clockwise direction of rotation, which is opposite to the direction of rotation of the actuating member 19.

The bolt 12 then reaches its locking position, with its hook 12*a* enveloping the complementary strike 11 (in particular its rod 11*a*).

The upper bearing portion 12*a*2 of the hook portion 12*a* bears on the elastically deformable member 25 so as to displace it towards an inactive position, and then take the place of the latter above the rod 11*a* of the strike 11.

This locking position of the bolt 12 is detected/determined by suitable control means, conventional per se, comprising for example a sensor on the bolt 12 and a sensor on the strike 11 (the sensor is for example a suitably arranged push-button contactor).

These control means hence allow to confirm that the two bolt 12/strike 11 couples are in the locking position.

The control means then stop the rotation of the bolt 12, taking into account the signal emitted by the above-mentioned control means.

The closed position of the lid 6 is then locked by the cooperation between the bolts 12 and their complementary strikes 11.

As illustrated by FIG. 10, in this arrangement, it is possible to define two longitudinal axes A1, A2, i.e.:

- a first longitudinal axis A1 passing through the longitudinal axis 19' of the actuating member 19 and through the motor axis of rotation 16', also corresponding herein to the radial longitudinal axis 18' of the crank 18, and
- a second longitudinal axis A2 passing through the longitudinal axis 19' of the actuating member 19 and through the axis of rotation 14 of the bolts 12, corresponding herein to the radial longitudinal axis 12*c*3 of the elongated hole 12*c* of the bolt 12.

In this locking position of the bolt 12 according to FIG. 10, the structure of the locking mechanism is adapted so that the first longitudinal axis A1 extends square, or at least approximately square, with respect to the second longitudinal axis A2.

As used herein, "approximately square" means a clearance of a few degrees, for example at most 5°, for the angle formed between the above-mentioned longitudinal axes A1 and A2 (hence comprised for example between 85° and 95°).

Still in this locking position of the bolt 12, the actuating member 19 bears on a portion of the rear longitudinal edge 12*c*1, called the "locking segment 12*c*11".

The locking segment 12*c*11 of the bolt 12—is located on this first longitudinal axis A1 passing through the actuating member 19 and through the motor axis of rotation 16', and—extends square, or at least approximately square, with respect to this first longitudinal axis A1.

This locking segment 12*c*11 extends on either side of the first longitudinal axis A1 square with respect to the second longitudinal axis A2, for example over a length of 1 cm on either side of this first axis A1.

Such a structure secures the locking of the lid 4.

Indeed, if the rotor 4 or a cup came to by accidentally detached during a centrifugation operation, this projected object would then generate a force on the lid 4 tending to its operation towards its open position.

The strikes 11 will then exert an upward pulling force, tending to rotationally operate the associated bolts 12 towards their unlocking position.

In this case, the locking segment 12*c*11 of the "motor" bolt 12, 121 will generate a pressing force on the actuating member 19, this force extending coaxially to the first longitudinal axis A1 and to the longitudinal axis 18' of the crank 18, towards the motor axis of the rotor 16'.

And due to this direction and orientation, this pressing force generates no lever arm on the actuating member 19, and thus a null moment on the motor axis of rotation 16'; no rotation force is then exerted on the associated crank 18.

There results therefrom a particularly effective holding in position of the bolt 12, which ensures an optimal securing of the bolts 12 in the locking position.

For the pivotal operation of the bolts 12 from their locking position to their unlocking position (FIG. 11), the operating means 15 cause the displacement of the actuating member 19 according to an eccentric rotation about the motor axis 16', in this case the clockwise direction in FIG. 11.

This actuating member 19 is hence brought to circulate and bear along the front longitudinal edge 12*c*2, causing the rotational control of the associated bolts 12.

Here again, this action causes a rotation of the bolt 121 in a direction of rotation that is opposite to the direction of rotation of the actuating member 19.

During this operation, the lower bearing portion 12*a*3 of the hook 12 is lifted up, thus playing a role of lever on the elastically deformable member 25 that causes the displacement thereof to an inactive position in which it is spaced apart from the travel direction of the strike 11 of the lid 6 towards its open position.

The holding means 25 being inactivated, the return means 61 of the lid 6 act so as to automatically cause the displacement of the lid 6 up to its open position (FIG. 1).

This unlocked position of the bolt 12 is here again detected/determined by suitable sensors, for example push-button contactors.

This position of the bolts 12 is temporary. They are automatically pivoted, by the operating means 15 associated to the control means, to the unlocking position with the holding means 25 in the active position, according to FIG. 7.

Here again, this unlocked position of the bolt 12 is detected/determined by suitable sensors, for example push-button contactors.

Generally, the operating means 15 according to the invention have for interest to be particularly compact (reduction of the number of parts), reliable and effective, for the rapid control of the bolts 12 and also for the holding in the locking position of said bolts 12 with their respective strikes 11.

This feature allows specially an optimal resistance of these locking means 10 against possible efforts generated by a rotor 4 or a portion of the rotor 4 colliding the lid 6, and then exerting a traction on the associated strikes 11.

This structure has moreover a relatively extended locking position, allowing a better taking into account of the inertia of the gear motors and simpler adjustments.

The invention claimed is:

1. A laboratory centrifuge (1) comprising:

a casing (2) surrounding a rotor (4) that is accessible through an opening (5), a lid (6) mobile between i) a closed position to close said access opening (5) and ii) an open position to clear said access opening (5), and means (10) for the locking of said lid (6) in said closed position, which locking means (10) comprise:

at least one strike (11), at least one bolt (12), which is mounted mobile in rotation about a stationary axis of rotation (14), driven into rotation about itself in the axis of rotation (14) between i) a locking position in which said bolt (12) is associated with said strike (11), and ii) an unlocking position in which said bolt (12) is dissociated from said strike (11), and operating means (15) of said bolt (12) comprising a motor shaft (16) that is driven into rotation by a motor (16*a*), according to a motor axis of rotation (16') extending parallel to the axis of rotation (14) of said bolt (12), and that is coupled to said bolt (12) through transmission means (17) for the rotational operation of said bolt (12) between the locking and unlocking positions, wherein said transmission means (17) comprise a crank (18), extending said motor shaft (16), which carries an actuating member (19) driven into eccentric rotation about said motor axis of rotation (16'), and wherein said actuating member (19) bears on a contact surface (12*c*1, 12*c*2) formed on said bolt (12), so that the driving into eccentric rotation of said actuating member (19) about said motor axis of rotation (16') causes circulation and bearing along said contact surface (12*c*1, 12*c*2) and the rotational control of said bolt (12) about the axis of rotation between locking and unlocking positions.

2. The laboratory centrifuge according to claim 1, wherein, a first longitudinal axis (A1) passes through the actuating member (19) and through the motor axis of rotation (16'), a second longitudinal axis (A2) passes through said actuating member (19) and through the axis of rotation of the bolt (14), and the locking means (10) are arranged so that, in the locking position of the bolt (12), said first longitudinal axis (A1) extends square, or at least approximately square, relative to the second longitudinal axis (A2).

3. The centrifuge according to claim 2, wherein the contact surface (12c1, 12c2) of the bolt (12) includes a locking segment (12c11) that, in the locking position of the bolt (12):

is located on the first longitudinal axis (A1) passing through the actuating member (19) and through the motor axis of rotation (16'), and extends square, or at least approximately square, with respect to said first longitudinal axis (A1).

4. The centrifuge according to claim 1, wherein the actuating member (19) comprises a cylindrical tenon that extends along a longitudinal axis (19') oriented parallel to the motor axis of rotation (16'), and the contact surface (12c1, 12c2) of the bolt (12) is formed by the contour of an elongated hole (12c) formed in said bolt (12), which elongated hole (12c) is delimited by two longitudinal edges (12c1, 12c2) extending parallel to, and on either side of, a radial longitudinal axis (12c3) arranged perpendicular to the axis of rotation (14) of said bolt (12).

5. The centrifuge according to claim 4, wherein the bolt (12) includes:

a hook (12a) adapted to cooperate with the strike (11), located on one side of the axis of rotation (14), and an extension (12b) in which is formed the elongated hole (12c), located on another side of the axis of rotation (14).

6. The centrifuge according to claim 1, wherein the strike(s) (11) equip the mobile lid (6), and the bolt(s) (12) equip the casing (2).

7. The centrifuge according to claim 6, wherein the lid (6) includes return means (61) tending to cause the operation thereof towards the open position, and said centrifuge (1) also includes means (25) for holding the lid in a waiting position allowing an adapted positioning of the strike (11) for the cooperation with the bolt (12) operated to the locking position, which holding means (25) are operable between two positions:

an active position, to automatically secure the lid (6) in said waiting position at the time of operation from the open position to the closed position, and an inactive position, obtained by the operation of the bolt (12) to the unlocking position, in which the holding means (25) are inactivated to allow the action of said means (61) for returning the lid (6) to the open position.

8. The centrifuge according to claim 7, wherein the holding means (25) comprise at least one elastically deformable member that is arranged to bear on the strike (11) of the lid (6) operated to the waiting position, and that is adapted to act against the action of the means (61) for returning the lid (6) towards the open position.

9. The centrifuge according to claim 8, wherein the elastically deformable member (25) is implanted opposite a hook (12a) of the bolt (12) intended to cooperate with the strike (11).

10. The centrifuge according to claim 9, wherein the bolt (12) includes a bearing portion (12a3) that is adapted, during the operation of the bolt (12) to the unlocking position, to cause an operation of said elastic deformable member (25) to the inactive position in which it is spaced apart from the strike (11) of the lid (6).

11. The centrifuge according to claim 1, wherein the lid (6) includes return means (61) tending to cause the operation thereof towards the open position, and said centrifuge (1) also includes means (25) for holding the lid in a waiting position allowing an adapted positioning of the strike (11) for the cooperation with the bolt (12) operated to the locking position, which holding means (25) are operable between two positions:

an active position, to automatically secure the lid (6) in said waiting position at the time of operation from the open position to the closed position, and an inactive position, obtained by the operation of the bolt (12) to the unlocking position, in which the holding means (25) are inactivated to allow the action of said means (61) for returning the lid (6) to the open position.

12. A laboratory centrifuge (1) comprising:

a casing (2) surrounding a rotor (4) that is accessible through an opening (5);

a lid (6) mobile between i) a closed position to close said access opening (5) and ii) an open position to clear said access opening (5);

means (10) for the locking of said lid (6) in said closed position, the locking means (10) comprising i) a strike (11) that equips the mobile lid, ii) a bolt (12) that equips the casing (2) and is mounted mobile in rotation about an axis of rotation (14) between a) a locking position in which said bolt (12) is associated with said strike (11), and a) an unlocking position in which said bolt (12) is dissociated from said strike (11), and operating means (15) of said bolt (12) comprising a motor shaft (16) that is driven into rotation by a motor (16a), according to a motor axis of rotation (16') extending parallel to the axis of rotation (14) of said bolt (12), and that is coupled to said bolt (12) through transmission means (17) for the rotational operation of said bolt (12) between the locking and unlocking positions, wherein said transmission means (17) comprise a crank (18), extending said motor shaft (16), the crank carrying an actuating member (19) bearing on a contact surface (12c1, 12c2) formed on said bolt (12), so that the driving into eccentric rotation of said actuating member (19) about said motor axis of rotation (16') causes circulation and bearing along said contact surface (12c1, 12c2) and the rotational control of said bolt (12) between locking and unlocking positions, wherein the lid (6) includes return means (61) tending to cause the operation thereof towards the open position; and means (25) for holding the lid in a waiting position allowing an adapted positioning of the strike (11) for the cooperation with the bolt (12) operated to the locking position, which holding means (25) are operable between two positions:

i) an active position, to automatically secure the lid (6) in said waiting position at the time of operation from the open position to the closed position, and ii) an inactive position, obtained by the operation of the bolt (12) to the unlocking position, in which the holding means (25) are inactivated to allow the action of said means (61) for returning the lid (6) to the open position.

13. The centrifuge according to claim 12, wherein the holding means (25) comprise at least one elastically deformable member that is arranged to bear on the strike (11) of the lid (6) operated to the waiting position, and that is adapted to act against the action of the means (61) for returning the lid (6) towards the open position.

14. The centrifuge according to claim 13, wherein the elastically deformable member (25) is implanted opposite a hook (12a) of the bolt (12) intended to cooperate with the strike (11).

15. The centrifuge according to claim 14, wherein the bolt (12) includes a bearing portion (12a3) that is adapted, during the operation of the bolt (12) to the unlocking position, to cause an operation of said elastic deformable member (25) to the inactive position in which it is spaced apart from the strike (11) of the lid (6).

16. The laboratory centrifuge according to claim 12, wherein, a first longitudinal axis (A1) passes through the actuating member (19) and through the motor axis of rotation (16'), a second longitudinal axis (A2) passes through said actuating member (19) and through the axis of rotation of the bolt (14), and the locking means (10) are arranged so that, in the locking position of the bolt (12), said first longitudinal axis (A1) extends square, or at least approximately square, relative to the second longitudinal axis (A2).

17. The centrifuge according to claim 16, wherein the contact surface (12*c*1, 12*c*2) of the bolt (12) includes a locking segment (12*c*11) that, in the locking position of the bolt (12) is located on the first longitudinal axis (A1) passing through the actuating member (19) and through the motor axis of rotation (16'), and extends square, or at least approximately square, with respect to said first longitudinal axis (A1).

18. The centrifuge according to claim 12, wherein the actuating member (19) consists in a cylindrical tenon that extends along a longitudinal axis (19') oriented parallel to the motor axis of rotation (16'), and the contact surface (12*c*1, 12*c*2) of the bolt (12) is formed by the contour of an elongated hole (12*c*) formed in said bolt (12), which elongated hole (12*c*) is delimited by two longitudinal edges (12*c*1, 12*c*2) extending parallel to, and on either side of, a radial longitudinal axis (12*c*3) arranged perpendicular to the axis of rotation (14) of said bolt (12).

19. The centrifuge according to claim 18, wherein the bolt (12) includes a hook (12*a*) adapted to cooperate with the strike (11), located on one side of the axis of rotation (14), and an extension (12*b*) in which is formed the elongated hole (12*c*), located on another side of the axis of rotation (14).

20. A laboratory centrifuge (1) comprising:

a casing (2) surrounding a rotor (4) that is accessible through an opening (5);

a lid (6) mobile between i) a closed position to close said access opening (5) and ii) an open position to clear said access opening (5);

means (10) for the locking of said lid (6) in said closed position, which locking means (10) comprise:

i) a strike (11), ii) a bolt (12), which is mounted mobile in rotation about an axis of rotation (14) between i) a locking position in which said bolt (12) is associated with said strike (11), and ii) an unlocking position in which said bolt (12) is dissociated from said strike (11), and iii) operating means (15) of said bolt (12) comprising a motor shaft (16) that is driven into rotation by a motor (16*a*), according to a motor axis of rotation (16') extending parallel to the axis of rotation (14) of said bolt (12), and that is coupled to said bolt (12) through transmission means (17) for the rotational operation of said bolt (12) between the locking and unlocking positions, wherein said transmission means (17) comprise a crank (18), extending said motor shaft (16), which carries an actuating member (19) bearing on a contact surface (12*c*1, 12*c*2) formed on said bolt (12), so that the driving into eccentric rotation of said actuating member (19) about said motor axis of rotation (16') causes circulation and bearing along said contact surface (12*c*1, 12*c*2) and the rotational control of said bolt (12) about the axis of rotation between locking and unlocking positions, and wherein the lid (6) includes return means (61) tending to cause the operation thereof towards the open position; and means (25) for holding the lid in a waiting position allowing an adapted positioning of the strike (11) for the cooperation with the bolt (12) operated to the locking position, which holding means (25) are operable between two positions:

i) an active position, to automatically secure the lid (6) in said waiting position at the time of operation from the open position to the closed position, and ii) an inactive position, obtained by the operation of the bolt (12) to the unlocking position, in which the holding means (25) are inactivated to allow the action of said means (61) for returning the lid (6) to the open position.

* * * * *